US007245858B2

(12) United States Patent
Okada et al.

(10) Patent No.: US 7,245,858 B2
(45) Date of Patent: Jul. 17, 2007

(54) GEAR MECHANISM AND IMAGE FORMING APPARATUS USING SAME

(75) Inventors: Tomohiko Okada, Kyoto (JP); Shinji Sugita, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 282 days.

(21) Appl. No.: 11/042,055

(22) Filed: Jan. 26, 2005

(65) Prior Publication Data

US 2005/0163535 A1 Jul. 28, 2005

(30) Foreign Application Priority Data

Jan. 27, 2004 (JP) ..... 2004-018669

(51) Int. Cl.
*G03G 15/00* (2006.01)

(52) U.S. Cl. ..... 399/167

(58) Field of Classification Search ..... 399/111, 399/116, 117, 167

See application file for complete search history.

(56) References Cited

U.S. PATENT DOCUMENTS

| | | | | |
|---|---|---|---|---|
| 4,823,160 | A * | 4/1989 | Ikuta et al. | 399/117 |
| 5,126,800 | A * | 6/1992 | Shishido et al. | 399/111 |
| 5,151,734 | A * | 9/1992 | Tsuda et al. | 399/111 |
| 5,749,028 | A * | 5/1998 | Damji et al. | 399/117 |
| 6,912,368 | B2 * | 6/2005 | Nagashima | 399/111 |
| 2005/0163531 | A1 * | 7/2005 | Kuroda | 399/116 |

FOREIGN PATENT DOCUMENTS

| | | | |
|---|---|---|---|
| JP | 02-062668 | A | 10/1990 |
| JP | 03287175 | A * | 12/1991 |
| JP | 05127442 | A * | 5/1993 |
| JP | 2000-147948 | A | 5/2000 |
| JP | 2000-267374 | A | 9/2000 |
| JP | 2002-278364 | A | 9/2002 |
| JP | 2002-304030 | A | 10/2002 |

* cited by examiner

*Primary Examiner*—Robert Beatty
(74) *Attorney, Agent, or Firm*—Blrch, Stewart, Kolasch & Birch, LLP

(57) ABSTRACT

A gear mechanism is arranged in such a manner that, a driven gear, which is detachable with respect to a first rotating shaft around which the driven gear rotates, is moved in a fitting direction along the axis of the first rotating shaft, so as to be fit with the first rotating shaft, and consequently the driven gear engages with a driving gear that has been positioned. In this gear mechanism, when the driven gear is moved in the fitting direction and the driven gear and the driving gear are about to engage with each other, the driven gear and the first rotating shaft are arranged so as to separate from each other in a direction perpendicular to the fitting direction.

4 Claims, 14 Drawing Sheets

X/2+Y/2=D

GEAR MECHANISM AND IMAGE FORMING APPARATUS USING SAME

This Nonprovisional application claims priority under 35 U.S.C. § 119(a) on Patent Application No. 2004-018669 filed in Japan on Jan. 27, 2004, the entire contents of which are hereby incorporated by reference.

BACKGROUND OF THE INVENTION

1. Field of the Invention

The present invention relates to an electro-photographic image forming apparatus such as a photocopier, a printer, and a facsimile machine, and also relates to a gear mechanism used therefor.

2. Description of the Related Art

A conventional electro-photographic image forming apparatus forms an image on a printer sheet in such a manner as to form a toner image by developing an electrostatic image formed on an image supporter, transfer this toner image to a printer sheet that is carried by carrying means, and fix the toner image on the printer sheet. As the image supporter, a cylindrical photoreceptor drum whose outer cylindrical surface is covered with a photosensitive coating film is typically used.

Since the photoreceptor drum must be regularly replaced for the sake of good image formation, the photoreceptor drum has a unit construction that allows the drum to be easily detached from the main body of the image forming apparatus (cf. Japanese Laid-Open Patent Application No. 2002-278364; published on Sep. 27, 2002). On this account, the photosensitive drum has driving force transmitting means by which the photoreceptor drum receives the rotative driving force from a rotative driving section of the main body of the image forming apparatus so as to rotate.

As this driving force transmitting means, gears, coupling means in which a concave-shaped driving section engages with a convex-shaped driven section, and the like are typically used.

When gears are adopted as the driving force transmitting means, it is necessary to keep the photoreceptor drum to smoothly rotate on account of good engagement of the gears, in order to suitably form an image by the photoreceptor drum. To achieve this, Japanese Laid-Open Patent Application No. 2000-147948 (published on May 26, 2000), Japanese Laid-Open Patent Application No. 2-262668/1990 (published on Oct. 25, 1990), Japanese Laid-Open Patent Application No. 2002-304030 (published on Oct. 18, 2002), and Japanese Laid-Open Patent Application No. 2000-267374 (published on Sep. 29, 2000) propose respective methods.

However, the tooth surfaces of a driving gear and a driven gear wear away in the course of the rotation of these gears engaging with each other, causing the engagement of these gears to go wrong even if these gears are at first engaged with each other without gaps or with suitable gaps. This brings about irregularity in the rotation of the photoreceptor drum, and the quality of a formed image may deteriorate. Taking this problem into account, the formation of gaps between the driving and driven gears is restrained even if the tooth surfaces thereof wear away to some extent, by utilizing the elasticity of the rotating shafts of the gears by narrowing the distance between the rotating shafts.

As shown in FIG. 11, a part of a driven gear 110 is inserted into the inside of a photoreceptor drum 100, and the driven gear 110 rotates around a rotating shaft 120. The driven gear 110 is driven by a driving gear 200 that engages with the driven gear 110 and rotates around a rotating shaft 210. The photosensitive drum 100 is pushed towards the rotating shaft 120, by a cleaning blade 300 that gathers toner remaining on the surface of the photoreceptor drum 100.

When the photoreceptor drum 100 and the members around the drum 100 are arranged as shown in FIG. 11, the distance between the rotating shafts 120 and 210 of the driving gear 200 and the driven gear 110 can be narrowed by, for instance, causing the rotating shaft 210 to tilt toward the rotating shaft 120, as shown in FIG. 12. It is noted that members such as the photoreceptor drum 100 are omitted from FIG. 12 for the sake of simplicity.

However, when the rotating shaft of one gear tilts toward the rotating shaft of the other gear as above, the driving gear and the driven gear may severely collide with each other if the photoreceptor drum is carelessly attached to the main body of the image forming apparatus. Such a collision damages and/or deforms the tooth surfaces, so that the state of engagement of the gears deteriorates and irregularity of the rotation of the photoreceptor drum is further facilitated.

That is to say, the photoreceptor drum 100 and the driven gear 110, which have not yet been fit with the main body of the image forming apparatus, are disposed as shown in FIG. 13. The photoreceptor drum 100 is then moved in the direction indicated by an arrow A in FIG. 14, so that the driven gear 110 is gradually fit with the rotating shaft 120.

In the present case, as described above, the rotating shaft 210 tilts toward the rotating shaft 120. That is, as shown in FIG. 12, these two rotating shafts are arranged in such a manner that, in the vertical direction, the distance (a) between the rotating shafts around the bases thereof is longer than the distance (b) between the rotating shafts around the tips thereof ($b<a$). Thus, as shown in FIG. 14, when the driven gear 110 is about to engage with the driving gear 200, the teeth of these gears 110 and 200 are likely to collide with each other as shown in FIG. 16, rather than properly engaging with each other as shown in FIG. 15. In this manner, the teeth of the gears collide with each other so that the tooth surfaces are damaged and/or deformed as described above.

SUMMARY OF THE INVENTION

The present invention was conceived to solve the above-identified problem. The objective of the present invention is therefore to provide (i) a gear mechanism in which two gears engage with each other without being damaged, and (ii) an image forming apparatus using the gear mechanism.

To achieve this objective, the gear mechanism of the present invention causes a first gear, which is detachable with respect to a first rotating shaft around which the first gear rotates, to move in a fitting direction along an axis of the first rotating shaft, so as to fit the first gear with the first rotating shaft, the gear mechanism thereby allowing the first gear to engage with a second gear that has been positioned, wherein, when the first gear is moved in the fitting direction and the first gear and the second gear are about to engage with each other, the first gear and second gear are separated from each other in a direction perpendicular to the fitting direction.

According to this arrangement, on the occasion when the first gear is moved in the fitting direction in order to fit the first gear with the first rotating shaft, and the first and second gears are about to engage with each other, the first gear and the first rotating shaft are arranged so as to separate from each other in a direction perpendicular to the fitting direction. On this account, the first gear on this occasion has not been fully fit with the first rotating shaft. Therefore, after the first and second gears start to engage with each other, the first gear is fully fit with the first rotating shaft and the positioning of this gear is completed.

In this manner, in the process from the start of the engagement of the gears to the complete positioning of the first gear by the first rotating shaft as a result of the motion of the first gear in the fitting direction, the teeth of the first gear move along the teeth of the second gear, so that the first gear spontaneously rotates and the first and second gears smoothly engage with each other.

Since the first and second gears smoothly engage with each other, it is possible to prevent the teeth of these gears from severely colliding with each other. As a result, it is possible to prevent the teeth of the gears from being damaged and/or deformed.

On this account, for instance, in a case where a digital photocopier to which a photoreceptor drum unit is attached in a detachable manner and a photoreceptor drum in the unit is caused to rotate using a first gear, it is possible to prevent the teeth of the first and second gears from being damaged, and prevent the photoreceptor drum from rotating irregularly. The prevent invention is therefore suitable for photocopiers, printers, and facsimile machines that can form high-quality images.

For a fuller understanding of the nature and advantages of the invention, reference should be made to the ensuing detailed description taken in conjunction with the accompanying drawings.

DESCRIPTION OF THE PRESENT INVENTION

Figure 2:
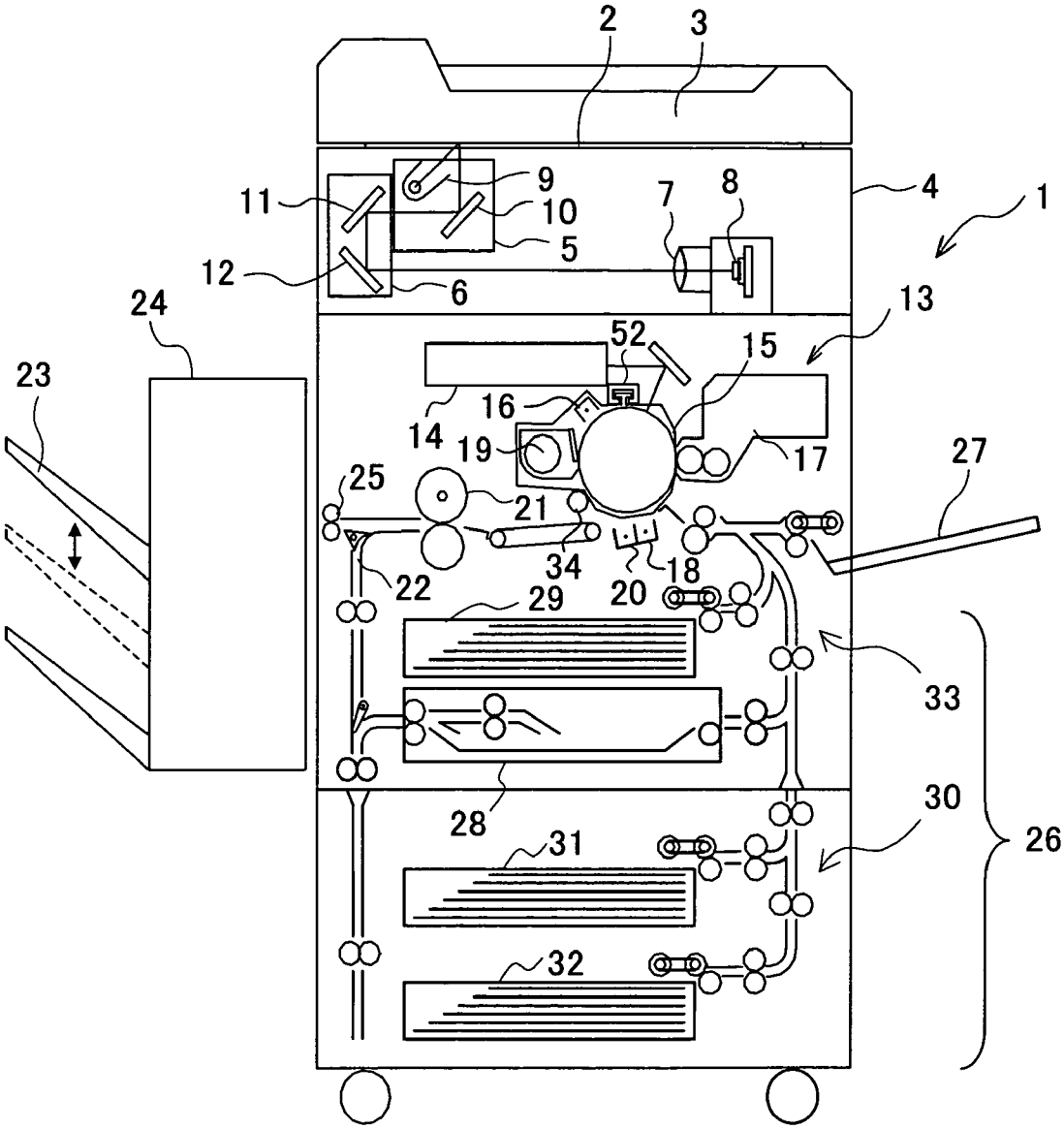
FIG. 2 is a cross section of a digital photocopier adopting the gear mechanism of FIG. 1.

FIG. 2 illustrates an outline of a digital photocopier (main apparatus, image forming apparatus) 1 of one embodiment of the present invention. As shown in the figure, on a document supporter 2 that is provided on the top of the digital photocopier 1 and is made of transparent glass, an automatic document feeding machine 3 is provided. It is noted that the automatic document feeding machine 3 automatically feeds printer sheets, which are set on a document set tray, to the document supporter 2 in a one by one manner.

A document reading section 4 is disposed below the document supporter 2, so as to scan and read an image on a document put on the document supporter 2. The document reading section 4 includes a first scanning unit 5, a second scanning unit 6, an optical lens 7, and a CCD line sensor 8 that is a photoelectric conversion element.

The first scanning unit 5 includes: an exposure lamp unit 9 that exposes the surface of a document to light; and a first mirror 10 that reflects, towards a predetermined direction, a photo-image coming from the document. The second scanning unit 6 includes second and third mirrors 11 and 12 that lead the light, which comes from the document and is reflected on the first mirror 10, to the CCD line sensor 8 that is the photoelectric conversion element. The optical lens 7 causes the light, which is reflected on the document, to focus on the CCD line sensor 8.

In conjunction with the automatic document feeding machine 3, the document reading section 4 reads, at a predetermined exposure position, an image on the document that is automatically fed by the automatic document feeding machine 3. The image on the document, which has been read by the document reading section 4, is sent to an image data input section (not illustrated), as image data. The image data supplied to the image data input section is subjected to predetermined image processing, and temporarily stored in a memory in an image processing section. In response to an output instruction, the image data is read out from the memory and transferred to a laser writing unit 14 that is an optical writing device of an image forming section 13.

The laser writing unit 14 includes: a semiconductor laser light source that emits a laser beam in accordance with the image data read out from the memory or image data transferred from an external device; a polygon mirror that deflects the laser beam at an isometric rate; and a f-θ lens that corrects the deflected laser beam to cause the beam to deflect, at an isometric rate, on the photoreceptor drum (image supporter) 15. In the present embodiment, the laser writing unit 14 is adopted as the writing device. Alternatively, as the writing device, it is possible to adopt a solid-scanning optical writing head unit using a light emitting element array such as an LED (Light Emitting Diode) and an EL (Electroluminescence).

Apart from the aforesaid members, the image forming section 13 includes the following members provided around the photoreceptor drum 15: a charging device 16 that causes the photoreceptor drum 15 to be charged with a predetermined voltage; a developing device 17 that supplies toner to an electrostatic latent image formed on the photoreceptor drum so as to visualize the latent image; a transfer device 18 that transfers, to a printer sheet, the toner image formed on the photoreceptor drum 15; a cleaning device 19 that collects redundant toner; and a diselectrifying device 20. The printer sheet to which the image has been transferred in the image forming section 13 is then supplied to a fixing unit 21, so that the image is fixed.

On the discharging side, the image forming section 13 is, in addition to the fixing unit 21, further provided with: a switchback path 22 that reverses the traveling direction of the printer sheet in order to form an image on the back side of the sheet; and a post-processing device 24 that subjects the printer sheet, on which the image is formed, to a stapling process and the like and that includes a movable tray 23. The printer sheet to which the toner image is fixed by the fixing unit 21 is, as the need arises, led to the post-processing device 24 by sheet discharging rollers 25 and via the switchback path 22. The printer sheet is subjected to post-processing in the post-processing device 24, and then discharged.

A sheet feeding section 26 is provided below the image forming section 13, and includes a manual paper feed tray 27 attached to the main body, a double-side printing unit 28, a printer sheet tray 29, and printer sheet trays 31 and 32 provided in a multi-stage sheet feeding section 30. The sheet feeding section 26 is further provided with carrying means 33 that supplies the printer sheet from the trays 27, 29, 31, and 32 to the transfer position where the transfer device 18 is provided.

The double-side printing unit 28 is connected to the switchback path 22 that reverses the printer sheet, and this unit 28 is used for forming images on the both sides of a printer sheet. Note that the double-side printing unit 28 may be replaced with a regular printer sheet cassette, so that the regular printer sheet cassette may be used in place of the double-side printing unit 28.

In the above-described digital photocopier 1, the photoreceptor drum 15 is driven by a driving gear (second gear) 34 that engages with a driven gear (not illustrated) of the photoreceptor drum 15. One of the characteristic features of the digital photocopier 1 of the present embodiment is an arrangement concerning the driving gear 34 and the driven gear, so that this feature will be specifically described below.

Figure 3:
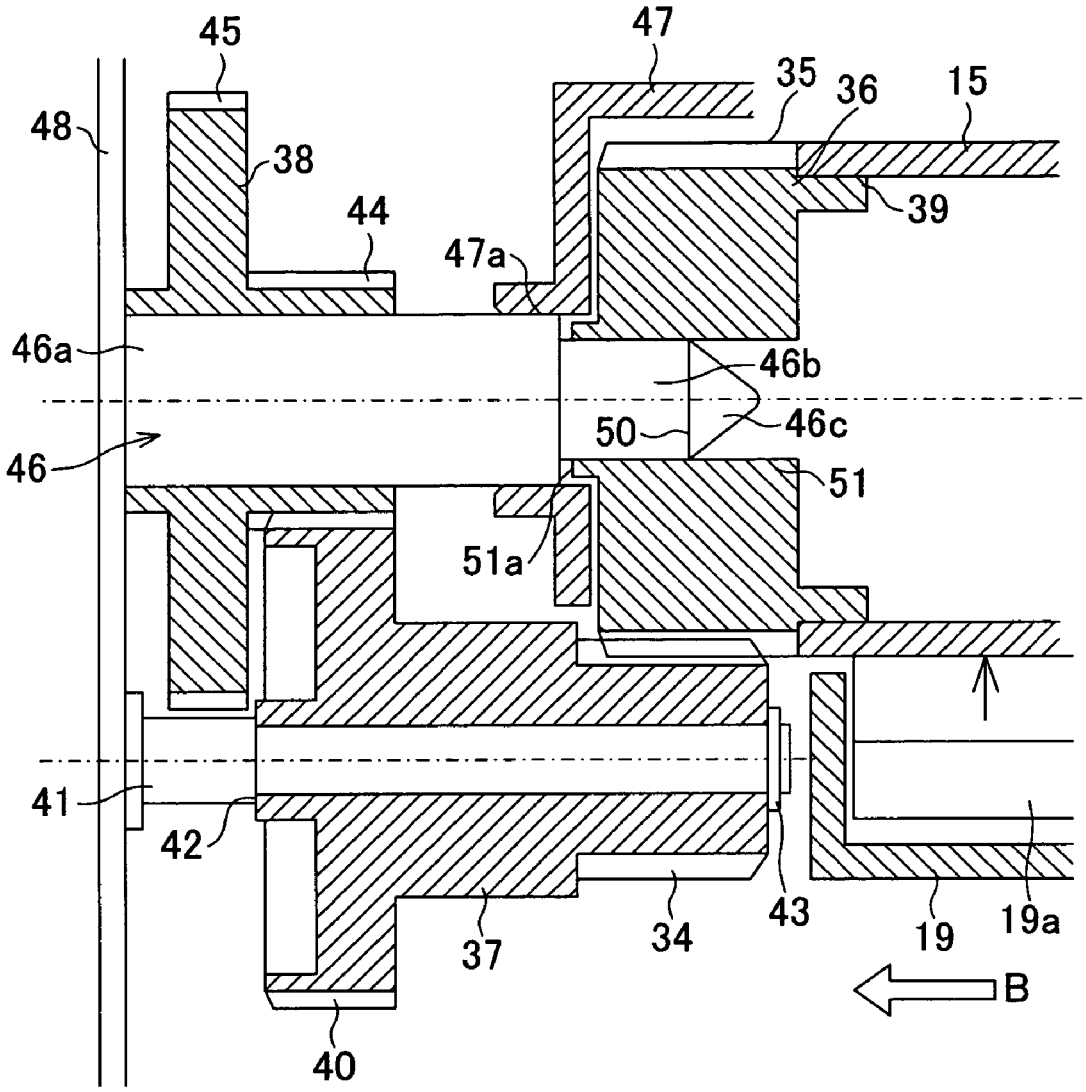
FIG. 3 is a cross section of the gear mechanism of FIG. 1, where a driving gear and a driven gear completely engage with each other.

As shown in FIG. 3, in order to rotate the photoreceptor drum 15, a flange 36, a first drum rotating member 37, and a second drum rotating member 38 are provided around the photoreceptor drum 15.

The flange 36 is arranged such that a driven gear (first gear) 35 engaging with the driving gear 34 is formed around the outer circumference of the flange 36, while an inserted section 39, which is made of aluminum and inserted into the photoreceptor drum 15, is formed on the edge of the flange 36. Further, the flange 36 has a mounting hole 51 by which the driven gear 35 is fit with the rotating shaft. The driven gear 35 of the flange 36 rotates in line with the rotation of the driving gear 34, thereby causing the photoreceptor drum 15 to rotate. It is also noted that the flange 36 is made of PC (polycarbonate resin).

The first drum rotating member 37 is made of POM (polyacetal resin). The driving gear 34 is formed around the outer circumference of the first drum rotating member 37 on the photoreceptor drum 15 side, while a gear 40 is formed around the outer circumference of the first drum rotating member 37 on the other side. The first drum rotating member 37 rotates around a second rotating shaft 41 made of SUS. It is noted that the second rotating shaft 41 has a stepped section 42 and a positioning plate 43, so that the first drum rotating member 37 sandwiched between the stepped section 42 and the positioning plate 43 is positioned so as not to move towards the axis of the second rotating shaft 41.

The second drum rotating member 38 is arranged in such a manner that, a gear 44 engaging with the gear 40 of the first drum rotating member 37 is formed around the outer circumference of the member 38 on the photoreceptor drum 15 side, while a gear 45 is formed around the outer circumference of the member 38 on the other side. The gear 45 is driven by a driving device (e.g. a motor; not illustrated) provided in the digital photocopier 1.

The flange 36 and the second drum rotating member 38 rotate around a fourth rotating shaft 46 made of SUS. That is to say, as the fourth rotating shaft 46, a third rotating shaft 46*a* that is a rotating shaft of the second drum rotating member 38 and a first rotating shaft 46*b* that is a rotating shaft of the flange 36 are integrated into one, in such a manner as to share the central axis. It is noted that the third rotating shaft 46*a* and the first rotating shaft 46*b* are not necessarily integrated into one, so that these shafts may be independent from each other.

Furthermore, on the side of the edge of the first rotating shaft 46*b*, i.e. on the side opposite to the side where the first rotating shaft 46*b* contacts the third rotating shaft 46*a*, a positioning guide 46*c* is formed in order to smoothly insert the driven gear 35 into the fist rotating shaft 46*b*. This positioning axis 46*c* will be specifically described below.

Figure 12:
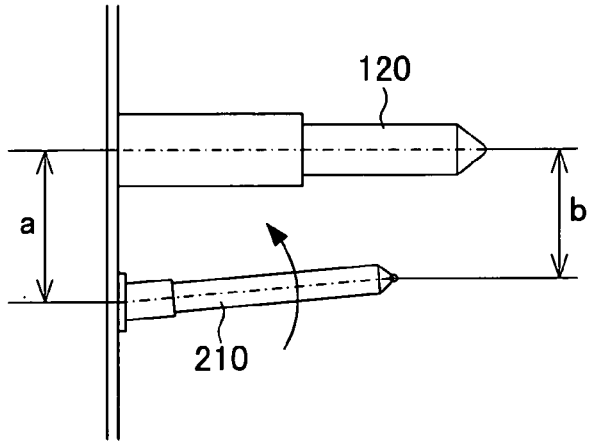
FIG. 12 is a cross section illustrating in what way the rotating shaft of the driving gear tilts toward the rotating shaft of the driven gear.
Figure 13:
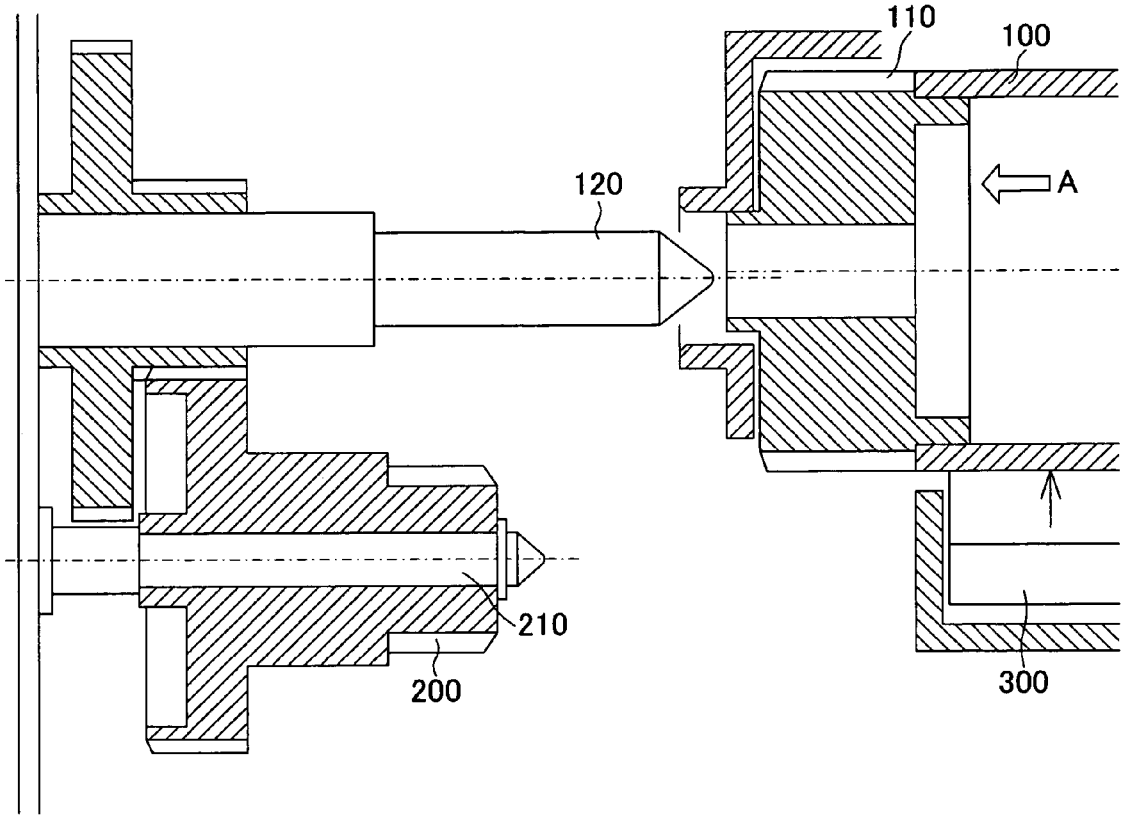
FIG. 13 is a cross section of the gear mechanism of FIG. 11, where the driven gear is not fit with the rotating shaft.
Figure 14:
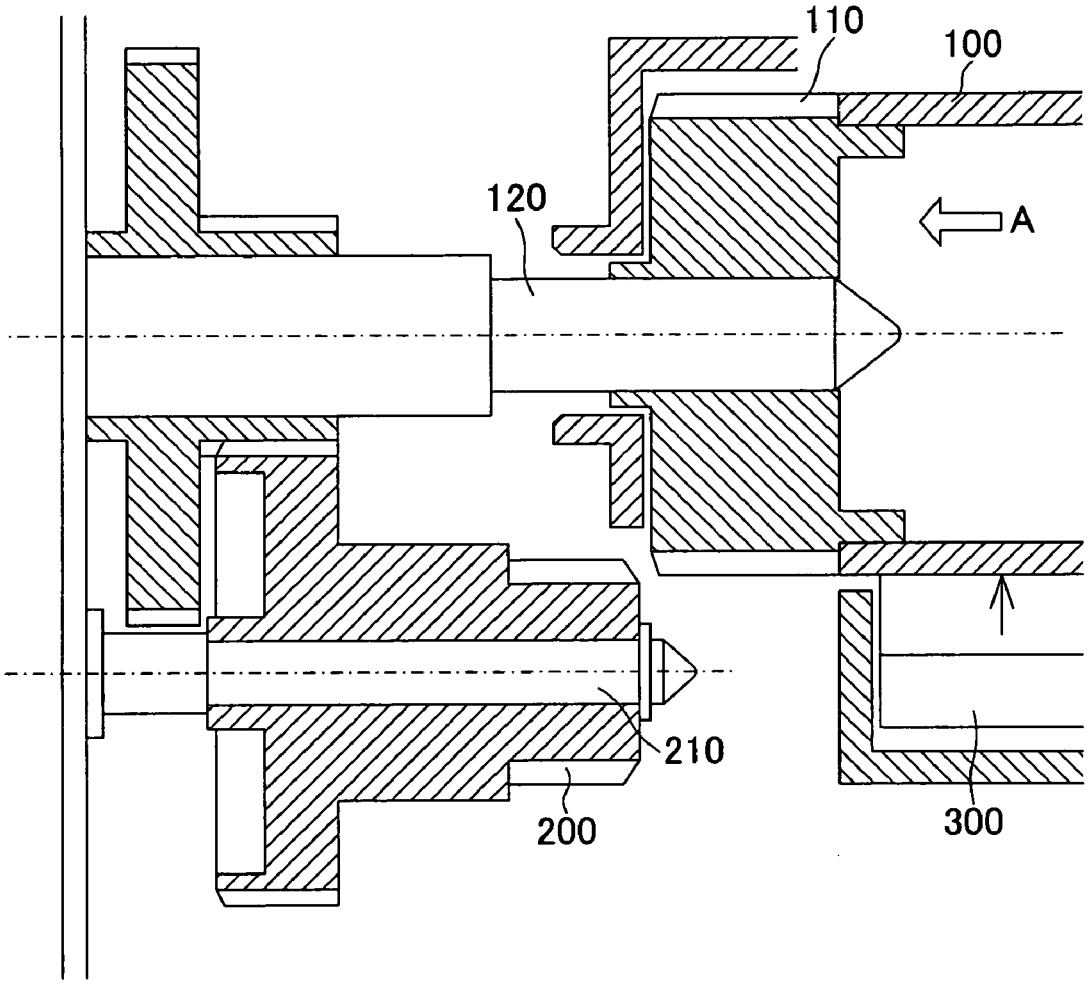
FIG. 14 is a cross section illustrating how the driven gear of the hear mechanism of FIG. 11 is moved in order to be fit with to the rotating shaft.
Figure 15:
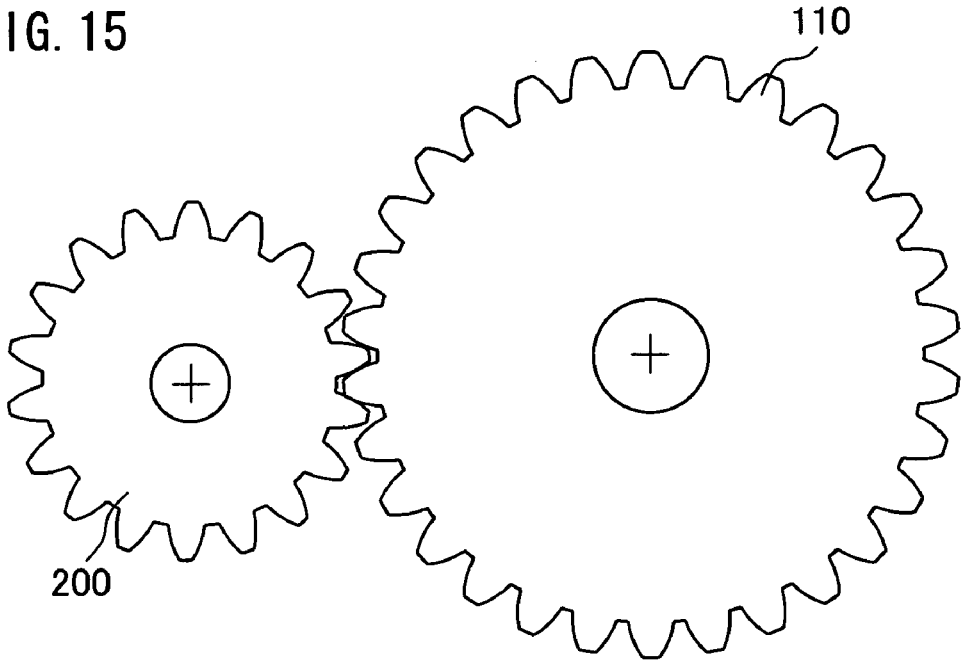
FIG. 15 is a cross section showing that the driving gear and the driven gear of the gear mechanism of FIG. 11 properly engage with each other.
Figure 16:
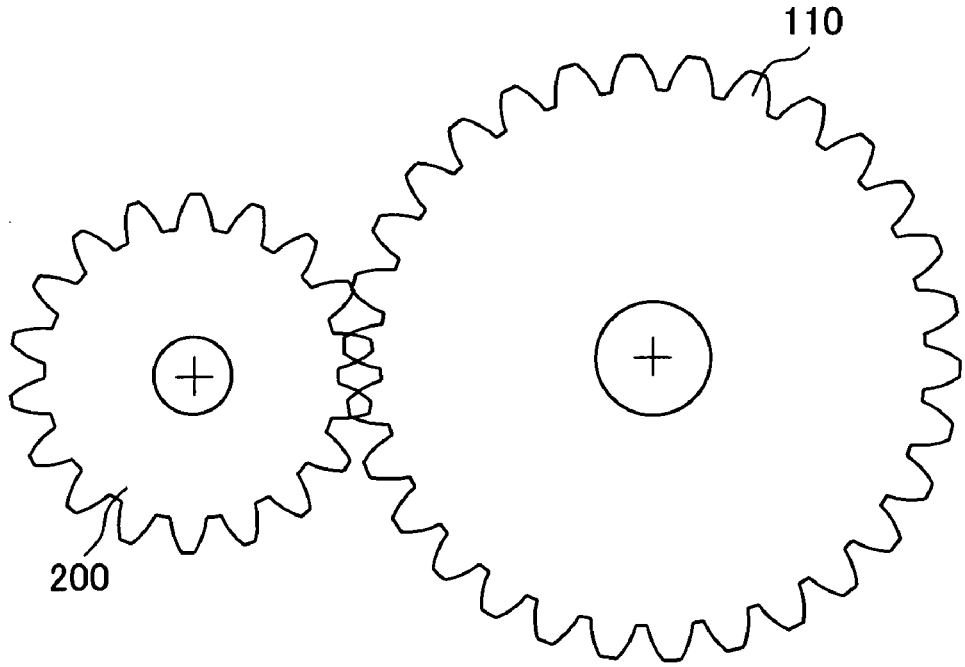
FIG. 16 is a cross section illustrating in what way the driven gear of the gear mechanism of FIG. 11 collides with the driving gear.

The second rotating shaft 41 and the fourth rotating shaft 46 may be arranged as shown in FIG. 12 which was referred to in Background of Invention. That is, the second rotating shaft 41 and the fourth rotating shaft 46 may be arranged in such a manner that, in the vertical direction, the distance between the rotating shafts around the bases of these shafts is longer than the distance between the rotating shafts around the tips of the shafts, so that the second rotating shaft 41 tilts toward the fourth rotating shaft 46. With this, the distance between the rotating shafts of the driven gear 35 and the driving gear 34 is narrowed, and hence the formation of gaps between the driving and driven gears is restrained by utilizing the elasticity of the rotating shafts, even if the tooth surfaces of the gears wear away to some extent.

Note that "distance around the bases in the vertical direction" indicates the distance in the vertical direction between (i) the axis of the second rotating shaft 41 at the point of contact with a frame 48 and (ii) the axis of the fourth rotating shaft 46 at the point of contact with the frame 48. On the other hand, "distance around the tips in the vertical direction" indicates the distance in the vertical direction between the axis of the second rotating shaft 41 at the tip thereof and the axis of the fourth rotating shaft 46 at the tip thereof.

Provided that the outer circumference of the photoreceptor drum 15 is about 30 mm long and a module of the gears is 0.7, it is preferable that the difference (a−b) between the vertical distance a (see FIG. 12) around the bases and the vertical distance b around the tips be approximately 0.4 mm. The distance, however, is not necessarily as such.

Furthermore, the outer circumference of the third rotating shaft 46*a* is in contact with a mounting hole 47*a* of a housing 47 that protects the flange 36 and the photoreceptor 15. The photoreceptor drum 15 is pushed toward the first rotating shaft 46*b*, by a cleaning blade 19*a* provided in the cleaning device 19.

The second rotating shaft 41 and the fourth rotating shaft 46 are supported by the frame 48 of the digital photocopier 1. Note that these rotating shafts 41 and 46 are not necessarily supported by the frame 48. That is to say, the following arrangement may be adopted: the first rotating shaft 46*b* of the fourth rotating shaft 46 is formed so as to be independent of the third rotating shaft 46*a*, and the first rotating shaft 46*b* is provided in a photoreceptor drum unit (not illustrated) that is detachable with respect to the digital photocopier 1. Further, the first rotating shaft 46*b* may be inserted into a predetermined position of the digital photocopier 1. Note that the photoreceptor drum unit sets up the photoreceptor drum and its peripheral devices as one unit, so as to allow the photoreceptor drum to be detachable with respect to the digital photocopier 1.

According to this arrangement, the second drum rotating member 38 rotates in line with the rotation of the gear 45. The rotation of the second drum rotating member 38 causes the first drum rotating member 37 to rotate through the intermediary of the gears 40 and 44, the rotation of the first drum rotating member 37 then causes the flange 36 to rotate through the intermediary of the gears 34 and 35, and consequently the photoreceptor drum 15 rotates.

Figure 1:
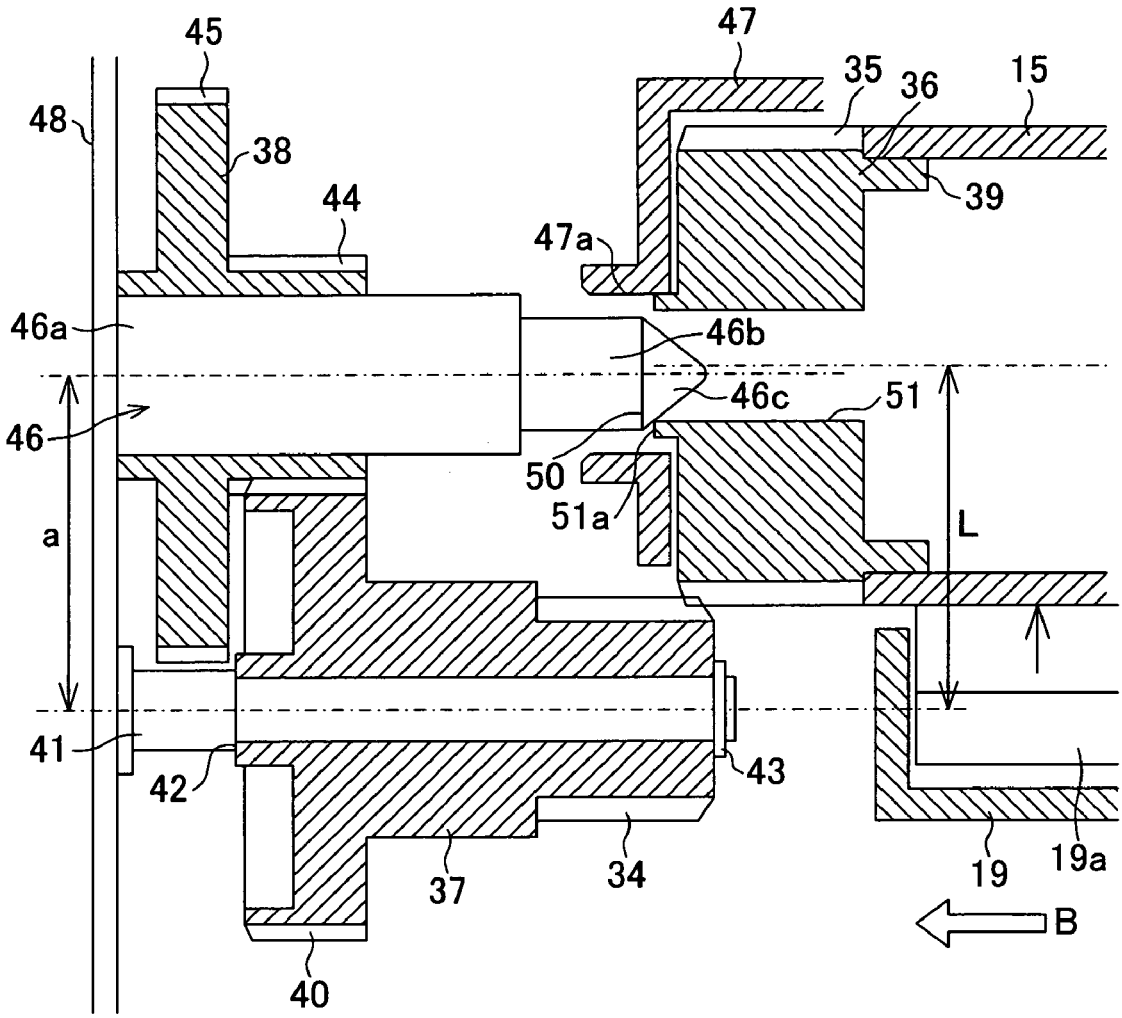
FIG. 1 is a cross section of a gear mechanism of an embodiment of the present invention.

One of the characteristic features of the digital photocopier 1 of the present embodiment lies in a point that the positioning of the driven gear 35 is completed after the driving gear 34 and the driven gear 35 start to engage with each other. That is to say, as shown in FIG. 1, provided that the driving gear 34 is about to engage with the driven gear 35, a periphery 50 at the tip of the first rotating shaft 46*b* and a periphery 51*a* that is formed on the flange 36 and on the insertion side of the mounting hole 51 are provided so as to separate from each other in the direction perpendicular to the axis of the first rotating shaft 46*b*.

It is noted that "periphery at the tip of the first rotating shaft 46*b*" indicates a periphery of the tip of the first rotating shaft 46*b*, the periphery being on the side where the driven gear 35 is fit with the first rotating shaft 46*b*. In other words, "periphery at the tip of the first rotating shaft 46*b*" indicates a periphery at the joint between the first rotating shaft 46*b* and the positioning guide 46*c*. In the meantime, "periphery on the insertion side of the mounting hole 51" indicates a periphery of the mounting hole 51, the periphery being on the side where the first rotating shaft 46*b* is inserted into the mounting hole 51.

Figure 4:
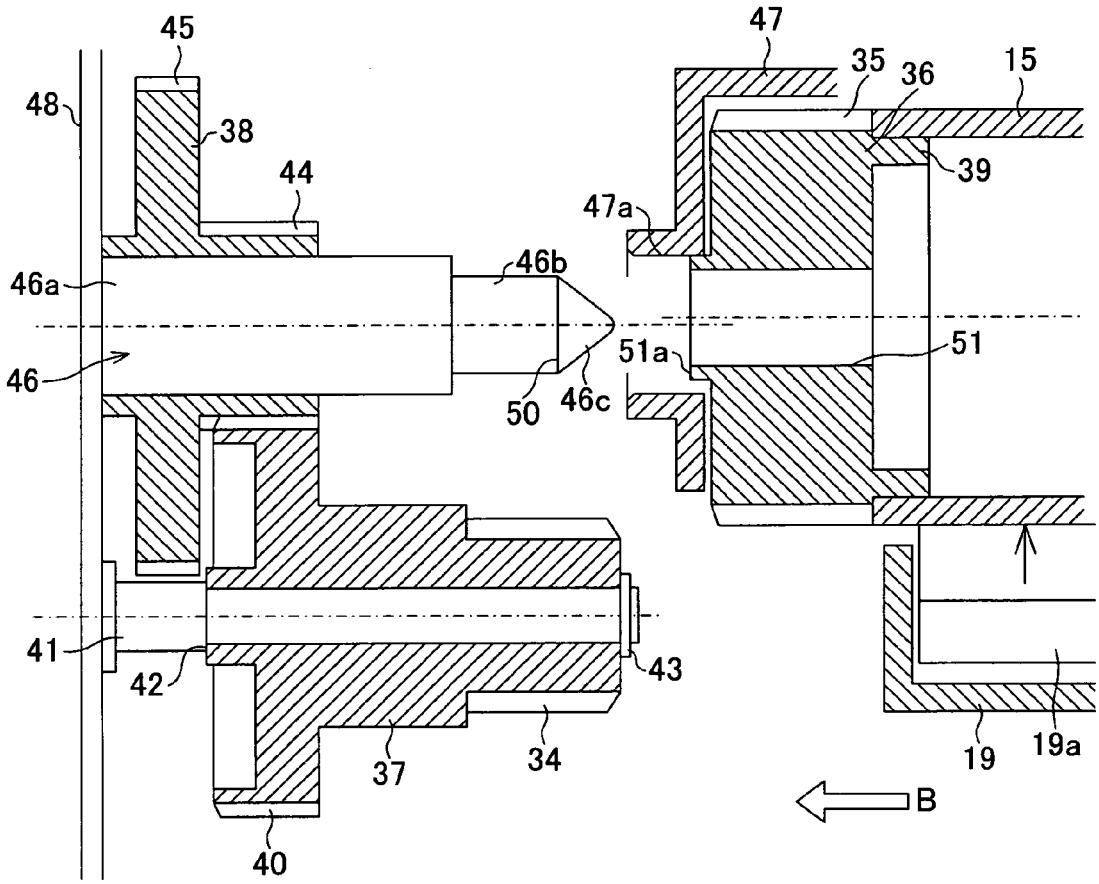
FIG. 4 is a cross section of the gear mechanism of FIG. 1, where the driven gear has not been fit with a rotating shaft.

The above-described arrangement brings about the following advantage. That is, the photoreceptor drum 15, the flange 36, and the housing 47, which have not been attached to the digital photocopier 1 as shown in FIG. 4, are moved in a direction indicated by an arrow B in the figure. This causes the driving gear 34 and the driven gear 35 to start to engage with each other as shown in FIG. 1. It is noted that the motion of the photoreceptor drum 15, the flange 36, and the housing 47 in the direction indicated by an arrow B is realized by sliding the photoreceptor drum unit including the aforesaid members, along a guide rail 52 (cf. FIG. 2).

Figure 5:
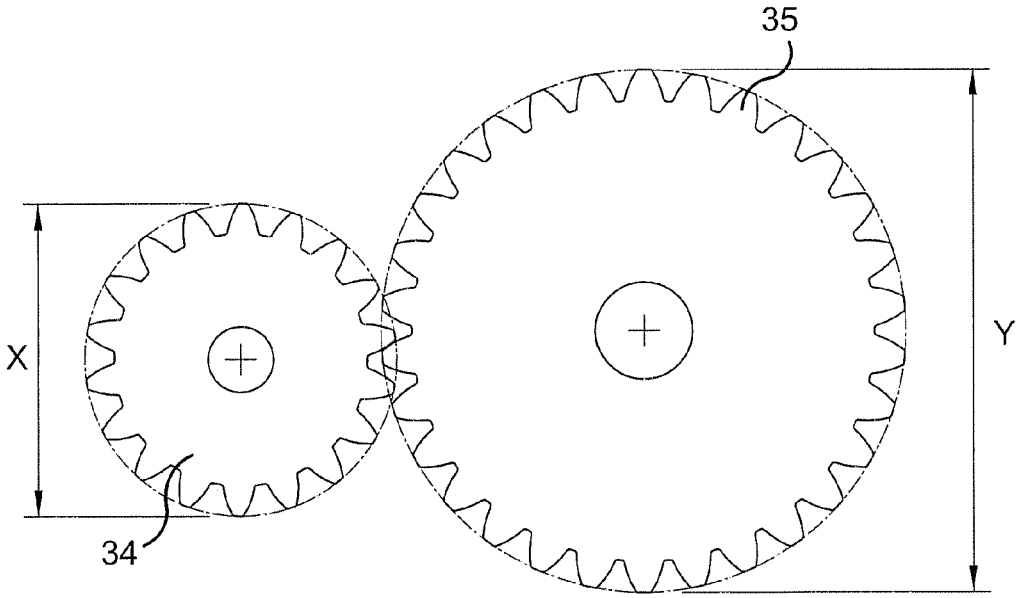
FIG. 5 is a cross section showing how the teeth of the driving gear and the teeth of the driven gear contact each other when the driving gear and the driven gear start to engage with each other.

As the driving gear 34 and the driven gear 35 start to engage with each other, the teeth of these gears get in touch with each other (see FIG. 5). Then as the photoreceptor drum unit moves in the direction indicated by the arrow B, the teeth of the driven gear 35 move along the teeth of the driving gear 34. With this, until the positioning of the driven gear 35 finishes as shown in FIG. 3, the driven gear 35 spontaneously rotates so that two gears smoothly engage with each other.

In summary, the driving gear 34 and the driven gear 35 smoothly engage with each other as described above, and hence it is possible to prevent the teeth of these gears from severely colliding with each other. As a result, the digital photocopier 1 of the present embodiment has such an advantage that the irregularity of the rotation of the photosensitive drum 15, due to the damage and/or deformation of the teeth of the gears, is prevented.

To further effectively prevent the severe collision of the teeth of the driving gear 34 and the teeth of the driven gear 35, it is preferable that the teeth of these gears be slightly in touch with each other, when the gears start to engage with each other. To do so, for instance, $D \geqq L > a$ is preferably satisfied, where (i) the total of the radiuses of circles defined by the tips of the teeth of the respective gears 34 and 35 is D (see FIG. 5), (ii) the distance between the axis of the rotating shaft of the driven gear 35 and the axis of the second rotating shaft 41 is L, and (iii) the distance between the axis of the first rotating shaft 46*b* and the axis of the second rotating shaft 41 is a. It is noted that the value L is worked out when the driven gear 35 is about to engage with the driving gear 34, while the value a is worked out between the positions where the second rotating shaft 41 and the fourth rotating shaft 46 are attached to the frame 48, respectively.

As described above, the photoreceptor drum 15 is pushed towards the first rotating shaft 46*b*, by the cleaning blade 19*a*. In this manner, the direction of pushing the photoreceptor drum 15 by the cleaning blade 19*a* is identical with the direction of separating the driving gear 34 from the driven gear 35. On this account, it can be seen that the teeth of two gears be caused to slightly contact each other at the time of starting the engagement of the driven gear 35 and the driving gear 34, by pushing the photoreceptor drum 15 by the cleaning blade 19*a*.

In addition to the above, the severe collision of the gears 34 and 35 can also be effectively avoided by smoothly fitting the driven gear 35 with the first rotating shaft 46*b*. The positioning guide 46*c*, which was not discussed above, is provided for smoothly fitting the driven gear 35 with the first rotating shaft 46*b*.

That is to say, the positioning guide 46*c* is tapered, so that the radius of the positioning guide 46*c* approaches that of the first rotating shaft 46*b*, as being closer to the first rotating shaft 46*b* along the axis thereof. With this, when the driven gear 35 is fit with the first rotating shaft 46*b*, the driven gear 35 moves along the side surface of the positioning guide 46*c*, thereby being smoothly fit with the first rotating shaft 46*b*.

It is noted that the positioning guide 46*c* is not limited to the tapered shape shown in FIG. 3. Therefore, as shown in FIG. 6, the positioning guide 46*c* may include a tapered part 46*d*, a cylindrical part 46*e*, and a guiding part 46*f*.

In this case, the tapered part 46*d* is formed in such a manner that the radius thereof approaches that of the first rotating shaft 46*b*, as being closer to the first rotating shaft 46*b* along the axis of the shaft 46*b*. The cylindrical part 46*e* has a cylindrical shape, and the radius thereof is identical with the radius of the end face of the tapered part 46*d* on the side opposite to the side where the tapered part 46*d* contacts the first rotating shaft 46*b*. The guiding part 46*f* is a tapered member, and the bottom surface of this guiding part 46*f* is identical with the cylindrical part 46*e*.

Figure 6:
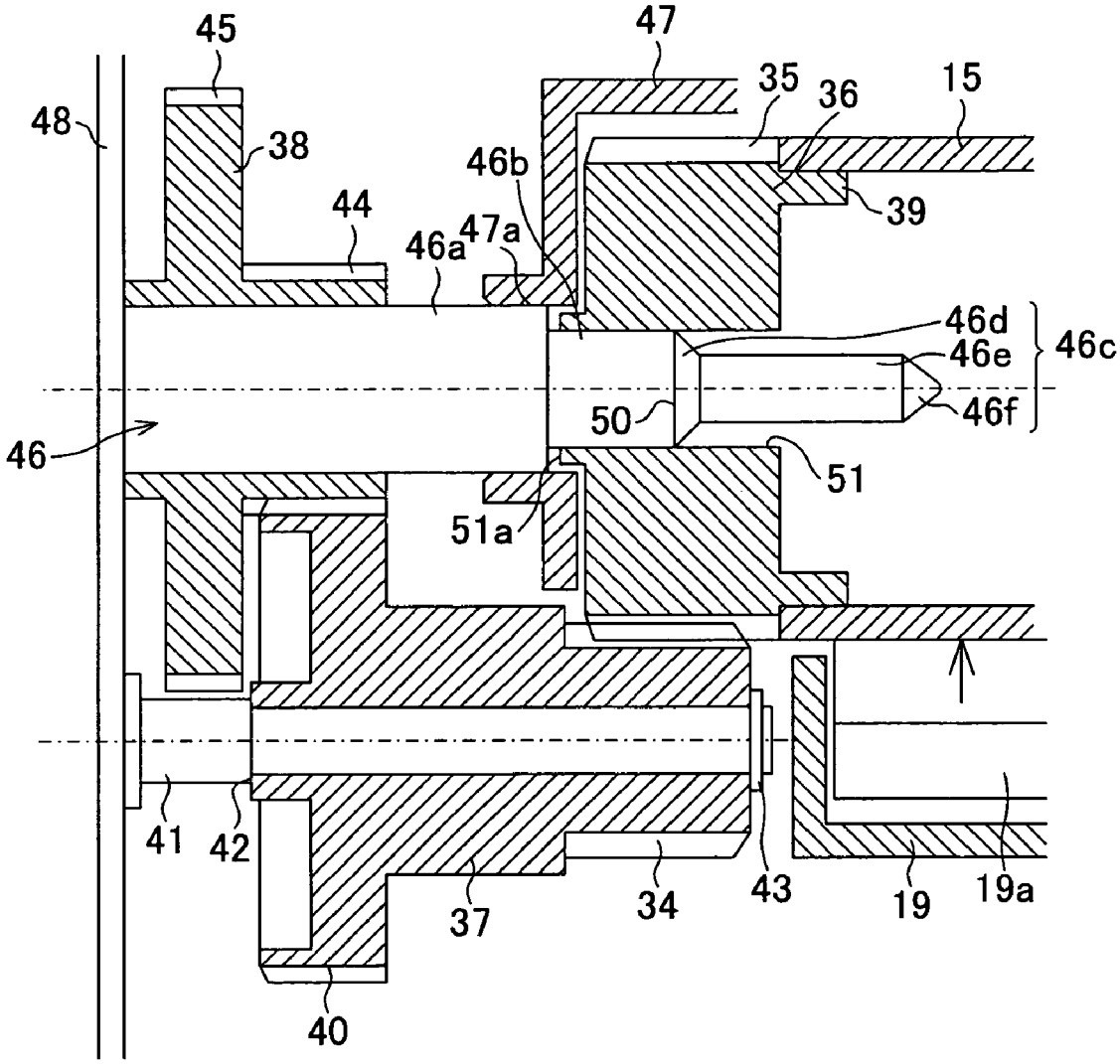
FIG. 6 is a cross section showing another arrangement of the positioning guide of the gear mechanism of FIG. 1.
Figure 7:
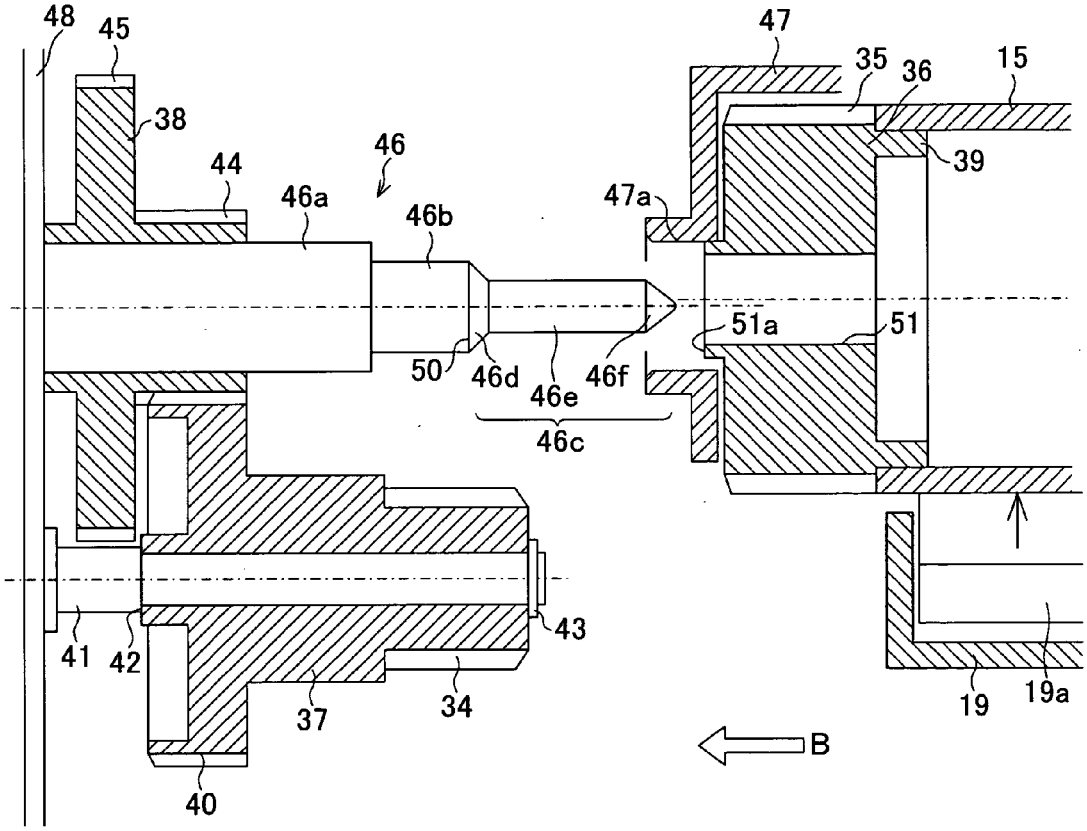
FIG. 7 is a cross section showing the gear mechanism of FIG. 6, where the driven gear has not yet been fit with the rotating shaft.
Figure 8:
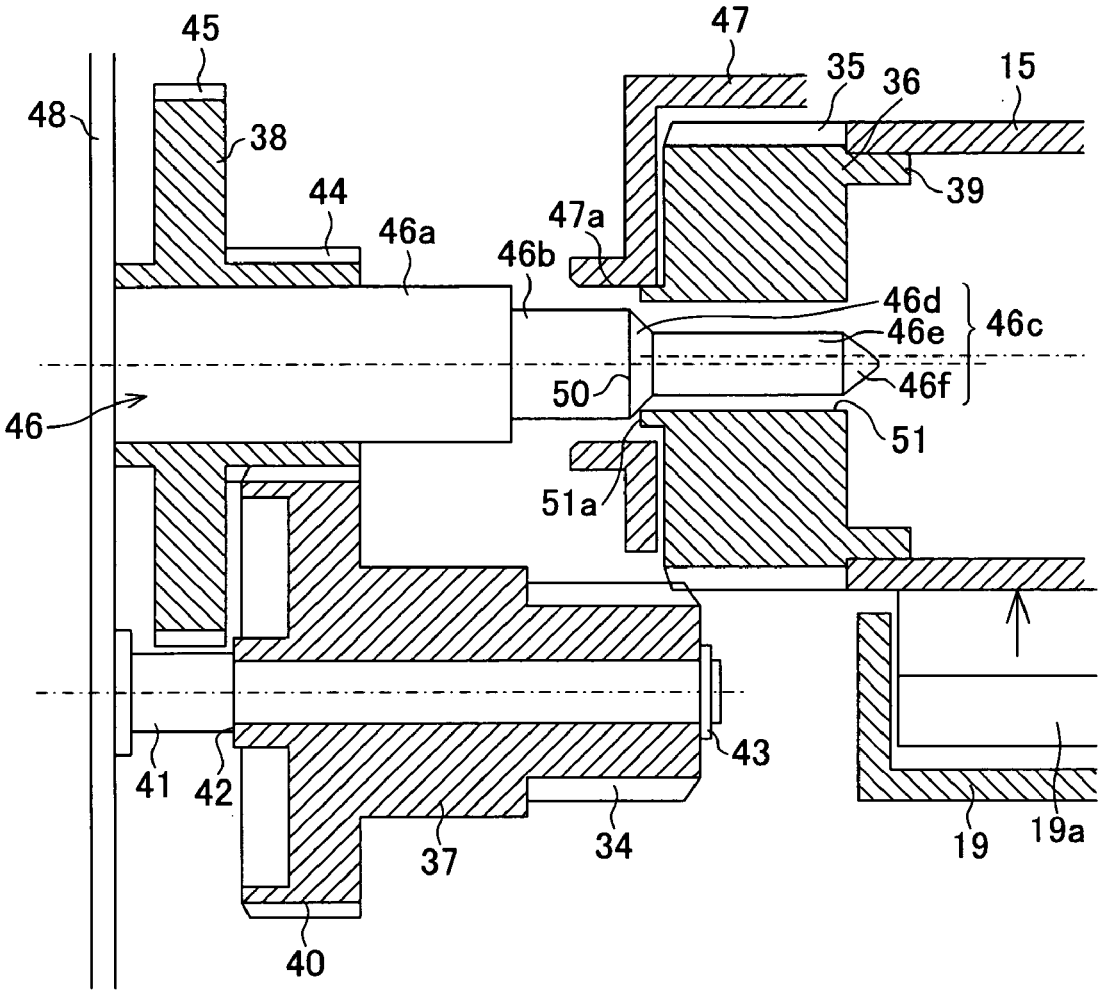
FIG. 8 is a cross section showing the gear mechanism of FIG. 6, where the driving gear and the driven gear are about to engage with each other.

As shown in FIG. 6, the following advantage is obtained if the positioning guide 46*c* is made up of the tapered part 46*d*, the cylindrical part 46*e*, and the guiding part 46*f*. That is, in the course of moving the driven gear 35 from the state shown in FIG. 7 (the driven gear 35 and the driving gear 35 are not about to engage with each other) to the state shown in FIG. 8 (the driven gear 35 and the driving gear 35 are about to engage with each other), it is possible to move the driven gear 35 along the side surfaces of the guiding part 46*f*, the cylindrical part 46*e*, and the tapered part 46*d*. With this, the driven gear 35 is fit with the first rotating shaft 46*b*, in a further smooth manner.

Figure 9:
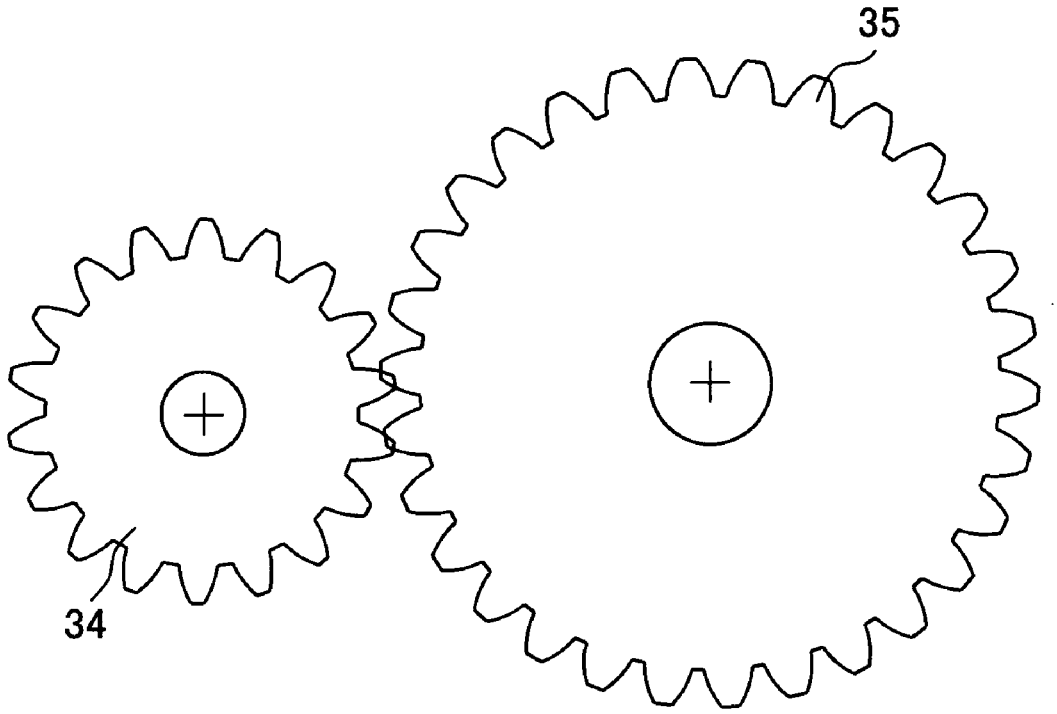
FIG. 9 is a cross section illustrating how the teeth of the driven gear collide with the teeth of the driving gear.

In the digital photocopier 1 of the present embodiment, the photoreceptor drum 15 and the driven gear 35 are moved by sliding the photoreceptor drum unit along the guide rail 52 (see FIG. 2). This motion of the photoreceptor drum 15 is relatively rough in terms of the accuracy of the motion. For this reason, it is not beyond the realm of possibility that the teeth of the driven gear 35 collide with the teeth of the driving gear 34 as shown in FIG. 9, in a case where the user carelessly move the photoreceptor drum unit.

Figure 10:
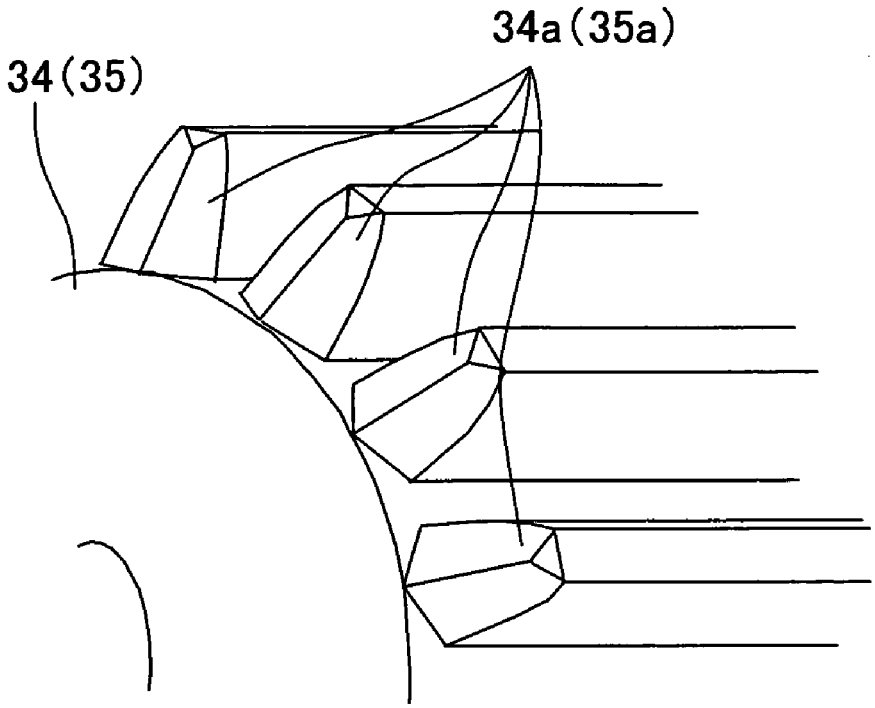
FIG. 10 is an oblique perspective view showing the end faces of the teeth of the driving gear or the driven gear, which have been subjected to chamfering.
Figure 11:
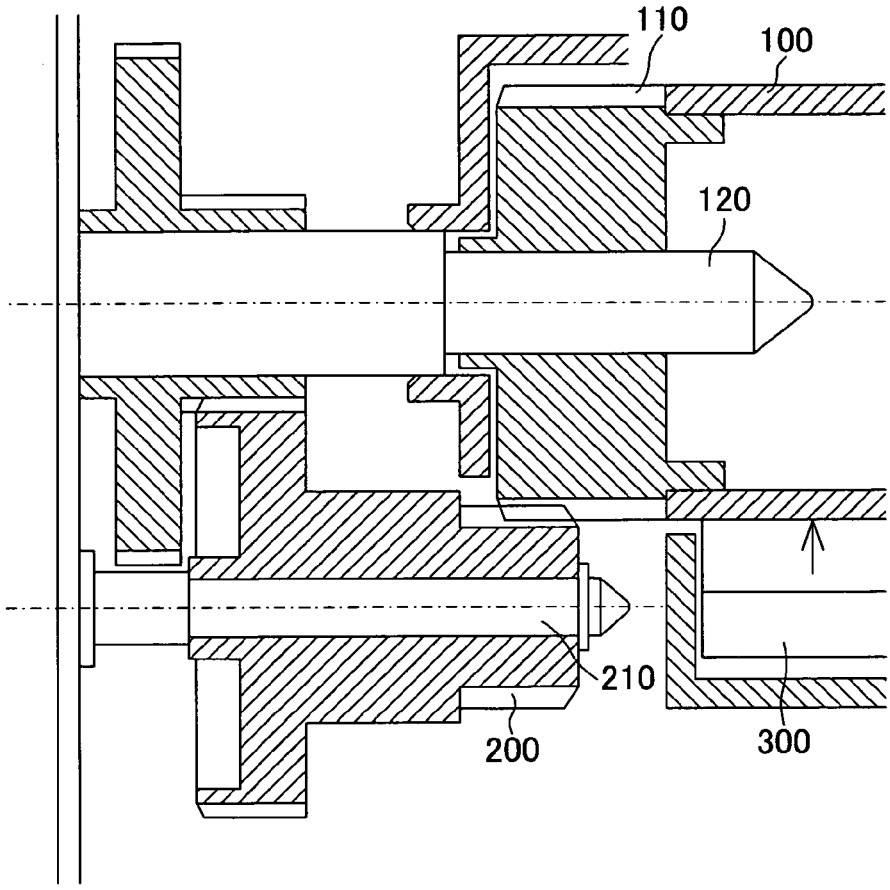
FIG. 11 is a cross section showing a driving gear and a driven gear used for rotating a photoreceptor drum of a conventional digital photocopier.

Taking this possibility into account, the end face of each tooth of the driving gear 34 and the driven gear 35 is subjected to chamfering 34*a* (35*a*) as shown in FIG. 10. It is noted that the chamfered end face is on the side where the driving gear 34 or the driven gear 35 faces the other gear, when the driven gear 35 is fit with the first rotating shaft 46. Chamfering the driving gear 34 and the driven gear 35 in this manner, the gears spontaneously rotate along the chamfered end faces even if the teeth of the gears collide with each other. The gears can therefore smoothly engage with each other. Note that instead of chamfering the teeth of both of the driving gear 34 and the driven gear 35 as above, only the teeth of either one of the gears is chamfered.

As described above, the digital photocopier 1 of the present embodiment adopts such a gear mechanism that the driven gear 35, which is detachable with respect to the first rotating shaft 46*b* around which the driven gear 35 rotates, is moved in the fitting direction, i.e. along the axis of the first rotating shaft 46*b*, thereby fitting with the first rotating shaft 46*b*, so that the driven gear 35 engages with the positioned driving gear 34. In the digital photocopier 1 of the present embodiment, moreover, when the driven gear 35 and the driving gear 34 are about to engage with each other as the driven gear 35 moves in the aforesaid fitting direction, the driven gear 35 and the first rotating shaft 46*b* are arranged so as to separate from each other in a direction perpendicular to the fitting direction.

According to this arrangement, the driven gear 35 separates from the first rotating shaft 46*b* in a direction perpendicular to the fitting direction, when the driven gear 35 is moved in the fitting direction in order to fit the driven gear 35 with the first rotating shaft 46*b*, and the driven gear 35 and the driving gear 34 starts to engage with each other. On this account, the driven gear 35 is not fully fit with the first rotating shaft 46*b* at this moment. Therefore, the driven gear 35 is fully fit with the first rotating shaft 46*b* and the positioning of the gear 35 is completed, after the driven gear 35 and the driving gear 34 start to engage with each other.

As a result, in the process from the start of the engagement of the gears to the complete fitting of the driven gear 35 with the first rotating shaft 46*b*, the teeth of the driven gear 35 move along the teeth of the driving gear 34. On this account, the driven gear 35 spontaneously rotates and the gears can smoothly engage with each other.

Since the driving gear 34 and the driven gear 35 smoothly engage with each other, the severe collision of these gears can be prevented. As a result, the damage and/or deformation of the teeth of the gears can be avoided. Moreover, failure in the rotation of the driven gear 35 can be obviated and the photoreceptor drum 15 can rotate without irregularity, so that a high-quality image formation is realized.

The aforesaid gear mechanism is preferably used for the photoreceptor drum unit detachable with respect to the digital photocopier 1, and preferably arranged such that the driver gear 35 is provided in the photoreceptor unit while the driving gear 34 is provided in the digital photocopier 1.

According to this arrangement, the driven gear 35 rotates in line with the rotation of the driving gear 34, with the driven gear 35 and the driving gear 34 engaging with each other. This causes the members in the unit to operate. On the occasion of fitting the unit with the digital photocopier 1, the teeth of the driving gear 34 and the driven gear 35 may be damaged if these gears severely collide with each other. If the teeth are damaged in this manner, the driven gear 35 may not properly rotate, so that the members in the unit, which are driven by the driven gear 35, also may malfunction.

In the present embodiment, however, the driven gear 35 and the first rotating shaft 46*b* are arranged so as to separate from each other in a direction perpendicular to the fitting direction, on the occasion of starting the engagement of the driven gear 35 and the driving gear 34. For this reason, in the process until the driven gear 35 is fully fit with the first rotating shaft 46*b*, the driven gear 35 spontaneously rotates so that the gears 34 and 35 smoothly engage with each other. On this account, the failure in the rotation of the driven gear 35 and the malfunction of the members in the unit can be obviated.

In the aforesaid gear mechanism, the tip of the first rotating shaft 46*b* on the side where the driven gear 35 is fit with the shaft 46*b* is preferably tapered. According to this arrangement, since the first rotating shaft 46*b* is tapered, the driven gear 35 can be smoothly fit with the first rotating shaft 46*b*. This makes it possible to effectively prevent the driven gear 35 and the driving gear 34 from colliding with each other. Also, it is possible to effectively prevent the teeth of these gears from being damaged.

In the aforesaid gear mechanism, the second rotating shaft 41, which is the rotation axis of the driving gear 34, and the first rotating shaft 46*b* are separated by a distance which is largest at the bases and decreases toward the tips.

According to this arrangement, the distance between the first rotating shaft 46*b* and the second rotating shaft 41 is narrowed, so that unnecessary gaps between the driving gear 34 and the driven gear 35 are eliminated when these gears engage with each other, and a primary stress that causes the gears to engage with each other is generated. On this account, it is possible to prevent the distance between the rotating shafts of the respective gears from broadening due to the stress generated at the time of transmitting power to the gears, and hence the gears engage with each other with no backlash. This makes it possible to restrain the irregularity in the rotation of the gears, for a long period of time.

In the aforesaid gear mechanism, it is preferable that one of the first rotating shaft 46*b* and the second rotating shaft 41 preferably tilt toward the other one of the rotating shafts.

According to this arrangement, it is possible to narrow the distance between the rotation shafts of the respective gears, by simply tilting one rotation shaft toward the other shaft. This simple arrangement makes it possible to eliminate the unnecessary gaps between the gears, so that the gears can rotate without irregularity, for a long period of time.

In the aforesaid gear mechanism, the distance between the central axis of the driven gear 35 and the central axis of the driving gear 34 is preferably identical with or less than the total of the radiuses of the circles defined by the tips of the teeth of the driven gear 35 and the driving gear 34, at the time of starting the engagement of these gears.

According to this arrangement, at the time of starting the engagement of the driven gear 35 with the driving gear 34, the teeth of these gears are slightly in touch with each other. This effectively prevents the gears from severely colliding with each other, so that the damage and deformation of the teeth of the gears can be effectively prevented.

Moreover, each tooth of one of the driven gear 35 and the driving gear 34 is preferably chamfered at the end face on the side of facing the other gear.

According to this arrangement, when the teeth of the driven gear 35 collide with the teeth of the driving gear 34 in the process of fitting the driven gear 35 with the first rotating shaft 46*b*, the gears spontaneously rotate along the chamfered end faces, so that the gears smoothly engage with each other. With this, it is possible to effectively prevent the teeth of the gears from being damaged.

The cleaning blade 19*a*, which gathers toner remaining on the photoreceptor drum 15, and the driving gear 34 are preferably provided on the same side with respect to the photoreceptor drum 15.

According to this arrangement, since the cleaning blade 19*a* and the driving gear 34 are on the same side with respect to the photoreceptor drum 15, the cleaning blade 19*a* pushes the photoreceptor drum 15, in the direction of separting the driven gear 35 from the driving gear 34. This causes the teeth of the driven gear 35 to slightly contact the teeth of the driving gear 34, thereby preventing the gears from severely colliding with each other. On this account, it is possible to ensure the acquisition of the digital photocopier 1 that can form a high-quality image.

As described above, the gear mechanism of the present invention causes a first gear, which is detachable with respect to a first rotating shaft around which the first gear rotates, to move in a fitting direction along an axis of the first rotating shaft, so as to fit the first gear with the first rotating shaft, the gear mechanism thereby allowing the first gear to engage with a second gear that has been positioned, the gear mechanism being wherein, when the first gear is moved in the fitting direction and the first gear and the second gear are about to engage with each other, the first gear and second gear separate from each other in a direction perpendicular to the fitting direction.

According to this arrangement, since the first and second gears smoothly engage with each other, it is possible to prevent the teeth of these gears from severely colliding with each other. As a result, it is possible to prevent the teeth of the gears from being damaged and/or deformed.

The aforesaid gear mechanism is preferably arranged such that the gear mechanism is used for a main apparatus and a unit that is detachable with respect to the main apparatus, the first gear is provided in the unit, and the second gear is provided in the main apparatus.

According to this arrangement, the first gear on the unit side rotates in line with the rotation of the second gear on the main apparatus side, with the first and second gears engaging with each other, and this causes the members in the unit to operate. If the first and second gears severely collide with each other at the time of fitting the unit with the main apparatus, the teeth of the gears may be damaged as described above. The damage on the teeth may cause-the irregularity of the rotation of the first gear, thereby inducing the malfunction of the members in the unit.

In the present invention, the first gear and the first rotating shaft are arranged so as to separate from each other in a direction perpendicular to the fitting direction, when the first and second gears are about to engage with each other. With this, in the process from the start of the engagement of two gears to the complete fitting of the first gear with the first rotating shaft, the first gear spontaneously rotates and the first and second gears smoothly engage with each other. This makes it possible to prevent the teeth of the gears from being damaged on account of the aforesaid collision of the gears. For this reason, it is possible to obviate the irregular rotation of the first gear and the malfunction of the members in the unit.

The aforesaid gear mechanism is preferably arranged such that a tip of the first rotating shaft, the tip being on a side where the first gear is fit, is tapered. According to this arrangement, since the first rotating shaft is tapered, the first gear is smoothly fit with the rotating shaft. This further encourages the prevention of the collision of the first and second gears, and also the damage on the teeth of the gears can be effectively prevented.

The aforesaid gear mechanism is preferably arranged such that a second rotating shaft around which the second gear rotates and the first rotating shaft are separated by a distance which is largest at bases and decreases toward tips.

According to this arrangement, the distance between the first and second rotating shafts is narrowed, so that unnecessary gaps between the first and second gears, which are formed when these gears engage with each other, are eliminated, and a primary stress that causes the gears to engage with each other is generated. On this account, it is possible to prevent the distance between the rotating shafts of the respective gears from broadening due to the stress generated at the time of transmitting power to the gears, and hence the gears engage with each other with no backlash. This makes it possible to restrain the irregularity in the rotation of the gears, for a long period of time.

The aforesaid gear mechanism is preferably arranged such that one of the first rotating shaft and the second rotating shaft tilts toward the other one of the first rotating shaft and the second rotating shaft.

According to this arrangement, it is possible to narrow the distance between the rotation shafts of the respective gears, by simply tilting one rotation shaft toward the other shaft. This simple arrangement makes it possible to eliminate the unnecessary gaps between these two gears, so that the gears can rotate without irregularity, for a long period of time.

The aforesaid gear mechanism is preferably arranged such that, when the first gear and the second gear are about to engage with each other, a distance between an axis of the first gear and an axis of the second gear is not more than a total of radiuses of the circles defined by the tips of the teeth of the first and second gears.

According to this arrangement, at the time of starting the engagement of the first and second gears, the teeth of these gears are slightly in touch with each other. This effectively prevents the gears from severely colliding with each other, so that the damage and deformation of the teeth of the gears can be effectively prevented.

The aforesaid gear mechanism is preferably arranged such that each tooth top of one of the first and second gears is chamfered at an end face that faces the other one of the first and second gears.

According to this arrangement, when the teeth of the first gear collide with the teeth of the second gear in the process of fitting the first gear with the first rotating shaft, the gears spontaneously rotate along the chamfered end faces, so that the gears smoothly engage with each other. With this, it is possible to effectively prevent the teeth of the gears from being damaged.

The image forming apparatus of the prevent invention adopts the gear mechanism of the present invention and being an electro-photographic type, and the unit includes an image supporter used for the image forming apparatus and the first gear causes the image supporter to rotate.

According to this arrangement, since the gear mechanism allowing the first and second gears to smoothly engage with each other is adopted, it is possible to prevent the teeth of the gears from being damaged on account of the collision of the gears, on the occasion of fitting the unit with the image forming apparatus.

For this reason, it is possible to obviate the irregularity in the rotation of the first gear and allow the image supporter to smoothly rotate, so that the image forming apparatus that can form a high-quality image can be provided.

Furthermore, the aforesaid unit preferably has a cleaning blade that gathers toner remaining on a surface of the image supporter and is provided on a same side with the second gear, with respect to the image supporter.

According to this arrangement, since the cleaning blade and the second gear are provided on the same side with respect to the image supporter, the cleaning blade pushes the image supporter in the direction of causing the first and second gears to separate from each other. This allows the teeth of the first gear to slightly contact the teeth of the second gear, and hence the severe collision of these two gears can be effectively prevented. It is therefore possible to certainly provide the image forming apparatus that can form a high-quality image.

The invention being thus described, it will be obvious that the present invention is not limited to the above-described embodiment and the same way may be varied in many ways.

What is claimed is:

1. An electro-photographic image forming apparatus adopting a gear mechanism that causes a first gear, which is detachable with respect to a first rotating shaft around which the first gear rotates, to move in a fitting direction along an axis of the first rotating shaft, so as to fit the first gear with the first rotating shaft, the gear mechanism thereby allowing the first gear to engage with a second gear that has been positioned, the first gear being detachable with respect to the image forming apparatus and provided in a unit including an image supporter, the second gear being provided in the image forming apparatus, and when the first gear is moved in the fitting direction and the first gear and the second gear are about to engage with each other, the first gear and the second gear separated from each other in a direction perpendicular to the fitting direction, wherein, in the unit, a cleaning blade for gathering toner remaining on a surface of the image supporter is provided on a same side with the second gear, with respect to the image supporter.

2. The image forming apparatus as defined in claim 1, wherein, a second rotating shaft around which the second gear rotates and the first rotating shaft are separated by a distance which is largest at the bases and decreases toward tips.

3. The image forming apparatus as defined in claim 1, wherein, one of the first rotating shaft and the second rotating shaft tilts toward the other one of the first rotating shaft and the second rotating shaft.

4. The image forming apparatus as defined in claim 1, wherein, when the first gear and the second gear are about to engage with each other, a distance between an axis of the first gear and an axis of the second gear is not more than a total of radii of circles defined by tips of teeth of the first and second gears.

* * * * *